US008967842B2

(12) United States Patent
Shah et al.

(10) Patent No.: US 8,967,842 B2
(45) Date of Patent: Mar. 3, 2015

(54) LAMP CONDENSATION REDUCTION SYSTEM

(71) Applicant: Toyota Motor Engineering & Manufacturing North America, Inc., Erlanger, KY (US)

(72) Inventors: Manish Shah, Canton, MI (US); Michal Ostrowski, Tipton, MI (US)

(73) Assignee: Toyota Motor Engineering & Manufacturing North America, Inc., Erlanger, KY (US)

( * ) Notice: Subject to any disclaimer, the term of this patent is extended or adjusted under 35 U.S.C. 154(b) by 34 days.

(21) Appl. No.: 13/927,731

(22) Filed: Jun. 26, 2013

(65) Prior Publication Data

US 2015/0003096 A1 Jan. 1, 2015

(51) Int. Cl.

| | |
|---|---|
| ***F21V 7/00*** | (2006.01) |
| ***F21V 7/20*** | (2006.01) |
| ***F21S 8/10*** | (2006.01) |

(52) U.S. Cl.

CPC ..... *F21S 48/335* (2013.01)
USPC ..... 362/516; 362/345

(58) Field of Classification Search

CPC ..... A01B 12/006; F21S 48/335; F21V 7/00; F21V 7/20
USPC ..... 362/459, 487, 506, 507, 509, 516, 362/543–545, 547
See application file for complete search history.

(56) References Cited

U.S. PATENT DOCUMENTS

| | | | | |
|---|---|---|---|---|
| 6,164,806 | A * | 12/2000 | Schmickl et al. | 362/547 |
| 2007/0091632 | A1 * | 4/2007 | Glovatsky et al. | 362/547 |
| 2010/0020563 | A1 * | 1/2010 | Ito et al. | 362/547 |

FOREIGN PATENT DOCUMENTS

| | | | |
|---|---|---|---|
| EP | 2020569 | A2 | 2/2009 |
| JP | 2004-119198 | | 4/2004 |
| JP | 2009021135 | A * | 1/2009 |

* cited by examiner

*Primary Examiner* — Donald Raleigh
(74) *Attorney, Agent, or Firm* — Christopher G. Darrow; Young Bastile Hanlon & MacFarlane P.C.

(57) ABSTRACT

Lamp assemblies for reducing headlamp condensation are disclosed. One example lamp assembly includes a lamp housing including a front housing and a rear housing forming a lamp cavity; a light source extending from the rear housing into the lamp cavity; a reflector extending around the light source; and a duct extending between the rear housing and the reflector from the light source to a remote section of the lamp cavity spaced from the light source. The duct can include a duct cavity configured to draw air from the remote section of the lamp cavity toward the light source to reduce condensation in the lamp cavity.

18 Claims, 4 Drawing Sheets

LAMP CONDENSATION REDUCTION SYSTEM

BACKGROUND

Enclosed vehicle lamp housings can include light sources such as vehicle headlamps, running lamps, fog lights, brake lamps, parking lights, and turn indicator lights for use in safe operation of a vehicle. The lamp housings are enclosed and/or sealed both for overall appearance of the vehicle and to prevent debris, water, or other contaminants from negatively impacting the effectiveness of the light source and reflective surfaces within the lamp housing. The air contained within the vehicle lamp housing may initially include, or can develop, some measure of humidity or moisture. The air within the vehicle lamp housing is also subject to rapidly changing temperatures depending on environmental conditions surrounding the vehicle and heat present within the vehicle lamp housing emitted by one or more of the light sources. As moist air cools from a heated state, condensation can form in areas of the enclosed vehicle lamp housing that are not adequately heated or vented.

SUMMARY

Lamp assemblies for reducing headlamp condensation are disclosed.

In one implementation, an example lamp assembly for reducing condensation is disclosed. The lamp assembly includes a rear housing; a front housing configured to mate to the rear housing to form a lamp cavity; a light source extending from the rear housing into the lamp cavity; a reflector extending from the rear housing toward the front housing adjacent to the light source; and a duct including a rear duct wall and spaced side duct walls extending between the rear housing and the reflector from the light source to a remote section of the lamp cavity spaced from the light source. The duct and a wall of the reflector form a duct cavity configured to draw air from the remote section of the lamp cavity toward the light source.

In another implementation, another example lamp assembly for reducing condensation is disclosed. The lamp assembly includes a rear housing; a front housing configured to mate to the rear housing to form a lamp cavity; a light source extending from the rear housing into the lamp cavity; a reflector extending from the rear housing toward the front housing adjacent to the light source; and a pair of spaced side duct walls extending substantially perpendicularly from the rear housing toward the reflector and extending from the light source to a remote section of the lamp cavity spaced from the light source. A front wall of the rear housing and a rear wall of the reflector and the spaced side duct walls form a duct cavity configured to draw air from the remote section of the lamp cavity toward the light source.

In another implementation, another example lamp assembly for reducing condensation is disclosed. The lamp assembly includes a lamp housing including a front housing and a rear housing forming a lamp cavity; a light source extending from the rear housing into the lamp cavity; a reflector extending around the light source; and a duct extending between the rear housing and the reflector from the light source to a remote section of the lamp cavity spaced from the light source.

BRIEF DESCRIPTION OF THE DRAWINGS

The description herein makes reference to the accompanying drawings wherein like reference numerals refer to like parts throughout the several views, and wherein.

DETAILED DESCRIPTION

Lamp assemblies designed to reduce condensation are described below. The lamp assemblies can include a transparent or semi-transparent front housing mated to a rear housing to form a sealed lamp cavity and one or more light sources extending from the rear housing into the lamp cavity. Each of the light sources can include a reflector extending from the rear housing around the light source configured to reflect light from the light source through the front housing. The lamp assemblies can also include a duct extending between the rear housing and the reflector from the light source to a remote section of the lamp cavity spaced from the light source. The duct can be integrated into the rear housing or separately mated to the rear housing, and when installed behind the rear wall of the reflector, can form a duct cavity to draw cool air from a remote section of the lamp cavity toward the light source. Once the air is heated, it rises and starts a circulation path within the sealed lamp cavity, reducing condensation formation in remote sections of the lamp cavity.

Figure 1:
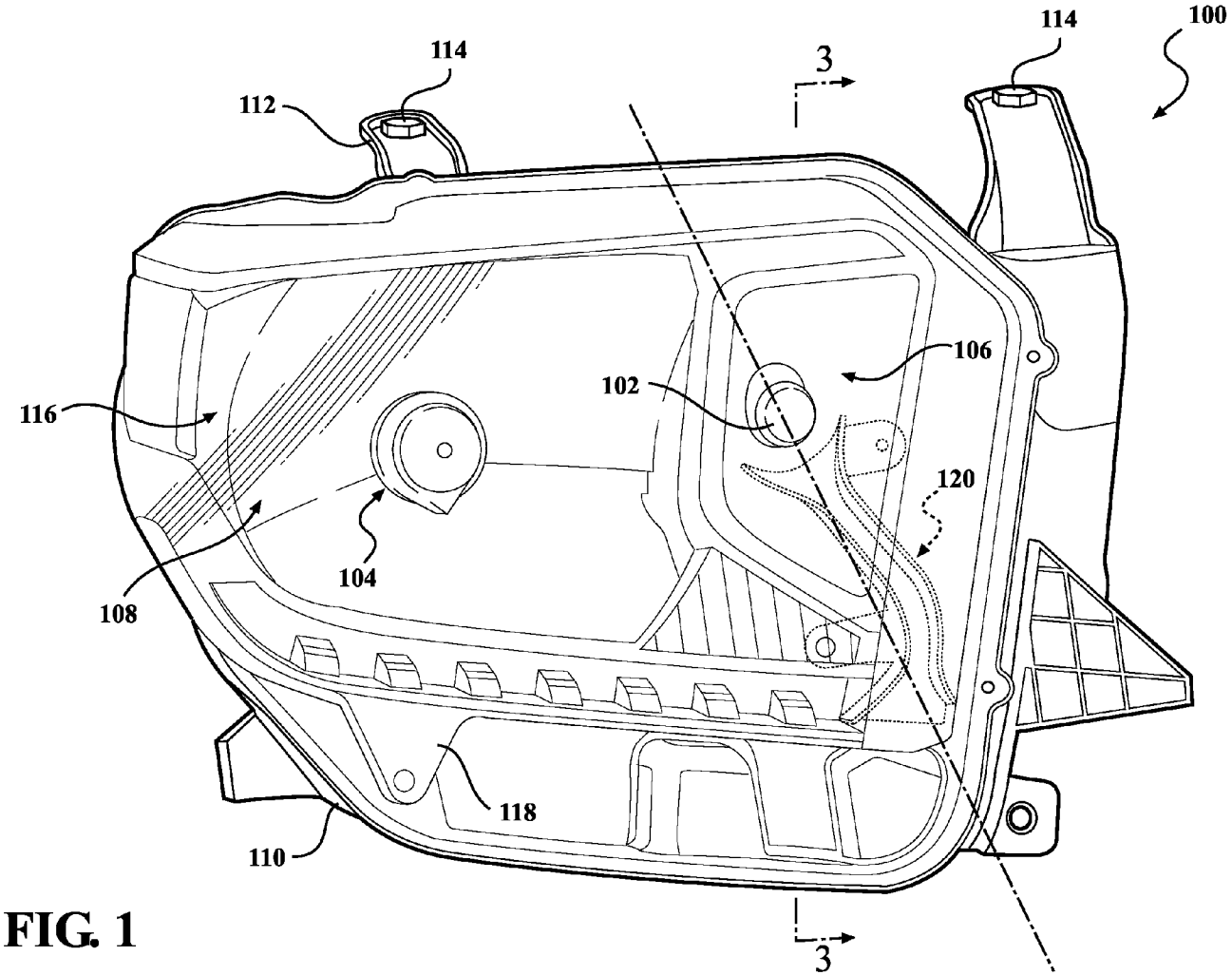
FIG. 1 is a front view of a vehicle headlamp assembly in accordance with one or more embodiments.

FIG. 1 is a front view of a vehicle headlamp assembly 100 in accordance with one or more embodiments. The example headlamp assembly 100 shown here includes two light sources: a park and turn lamp 102 and a high and low beam lamp 104. Each of the lamps 102, 104 is surrounded by a reflector. The park and turn reflector 106 extends around the park and turn lamp 102, and the main reflector 108 extends around the high and low beam lamp 104. Each of the reflectors 106, 108 can reflect light emitted by one of the lamps 102, 104 and is shaped to direct and intensify the light being projected from the headlamp assembly 100.

The headlamp assembly 100 of FIG. 1 can include a rear housing 110. The rear housing can include various means for attaching the headlamp assembly 100 to a vehicle, for example, brackets, tabs, or shelf extensions either including or designed to receive various fasteners. One example bracket 112 is shown as including a nut 114 for use in attaching the headlamp assembly 100 to a vehicle. The rear housing 110 can also include means for attaching or receiving the lamps 102, 104 and for attaching the reflectors 106, 108 which extend from the base of each lamp 102, 104 to partially surround the lamps 102, 104.

The headlamp assembly 100 can also include a front housing 116 designed to mate to the rear housing 110. The front housing 116 can be substantially transparent to allow light to pass through it. Mating the front housing 116 and the rear housing 110 can form a lamp cavity, the lamps 102, 104 and reflectors 106, 108 being disposed within the lamp cavity. The rear housing 110 and front housing 116 can also be designed to include seals or other complementary surfaces that keep air, water, and other debris from entering the lamp cavity and affecting the operation of the lamps 102, 104 and reflectors 106, 108. Despite effective sealing between the rear housing 110 and front housing 116, some level of moisture can be trapped or can become present in the air sealed within the lamp cavity.

The headlamp assembly 100 of FIG. 1 can also include a decorative bezel 118. The bezel 118 can be installed between the front housing 116 and the reflectors 106, 108 in order to optimize the path of light being emitted from the headlamp assembly 100 through the front housing 116. The bezel 118 can also be installed to improve the appearance of the headlamp assembly 100 and/or cover other internal components within the headlamp assembly 100. In other example headlamp assemblies, the bezel 118 can be absent.

The headlamp assembly 100 can also include a duct 120 extending between the rear housing 110 and the park and turn reflector 106 from the park and turn lamp 102 to a remote section of the lamp cavity spaced apart from the park and turn lamp 102 as shown in FIG. 1. An additional or alternate duct (not shown) can be positioned to extend between the rear housing 110 and the main reflector 108 from the high and low beam lamp 104 to a different remote section of the lamp cavity spaced apart from the high and low beam lamp 104. In some embodiments, the remote section of the lamp cavity is below the light source, e.g. the park and turn lamp 102 or the high and low beam lamp 104.

The dotted line shown in FIG. 1 extends from the top center of the headlamp assembly 100 through the rear housing 110 and the front housing 116, through the bezel 118, through the park and turn reflector 106 and the park and turn lamp 102, through the duct 120, through the remote section of the lamp cavity spaced from the park and turn lamp 102, and back through the bezel 118 and front housing 116. The sectional view through the dotted line is further described in reference to FIG. 3 below. The location and function of the duct 120 is further described in reference to exploded FIG. 2 and the sectional view of FIG. 3 below.

Figure 2:
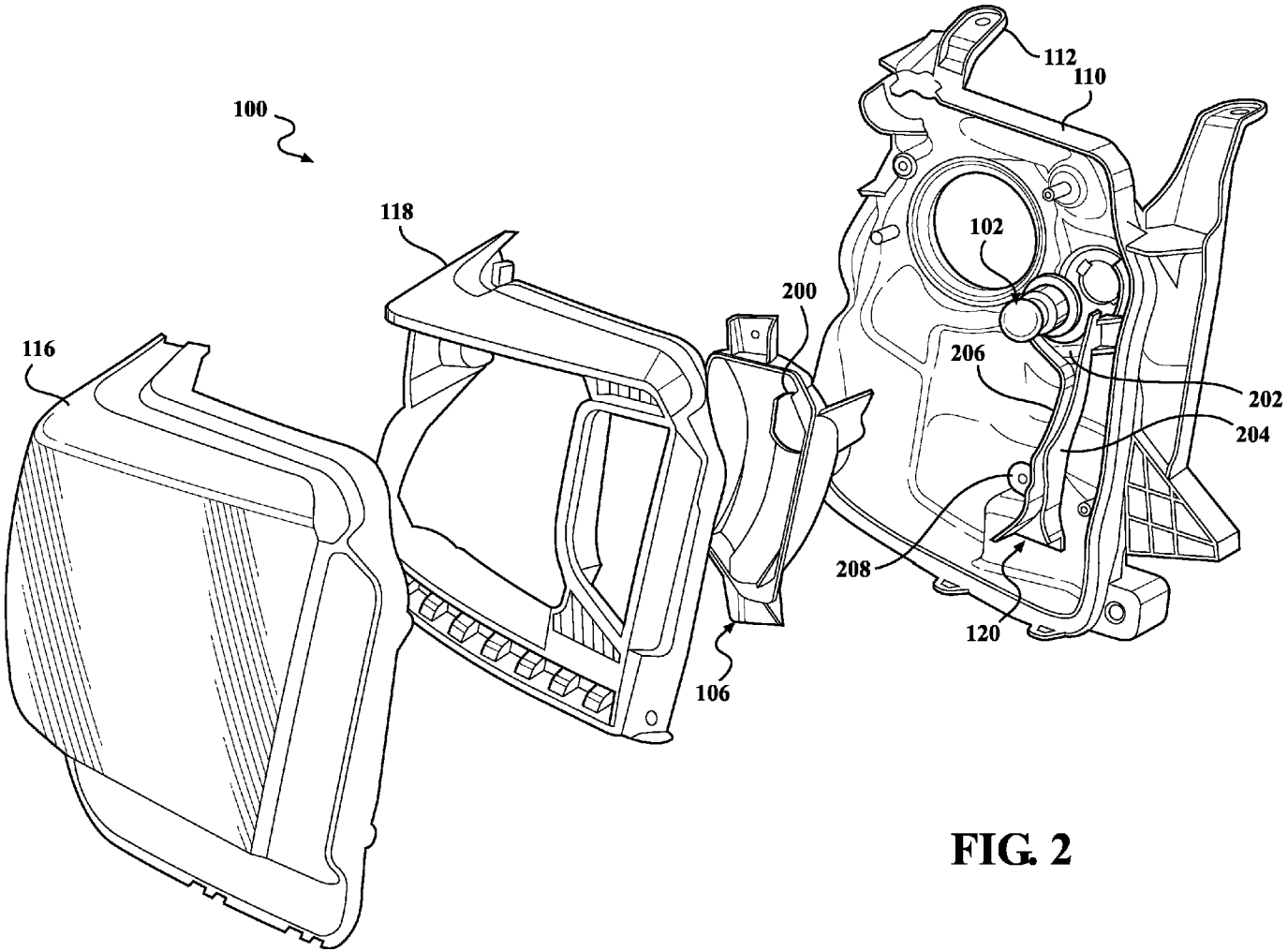
FIG. 2 is an exploded view of the vehicle headlamp assembly of FIG. 1.

FIG. 2 is an exploded view of the vehicle headlamp assembly 100 of FIG. 1. As described in FIG. 1, the headlamp assembly 100 includes the transparent, or partially transparent, front housing 116. The bezel 118 is located beneath the front housing 116. The park and turn reflector 106 is located beneath the bezel 118 and can include a lamp opening 200 for receiving the park and turn lamp 102 which extends from the rear housing 110. The rear housing 110 also includes various means for attaching the headlamp assembly 100 to a vehicle, for example, bracket 112 extending from the rear housing 110.

The duct 120 can extend between the park and turn reflector 106 and the rear housing 110 and can include a rear duct wall 202 and spaced side duct walls 204, 206. The duct 120 can also include brackets, such as bracket 208, or other means for mounting the duct 120 to the rear housing 110 beneath the park and turn reflector 106. In the example headlamp assembly 100 shown in FIG. 2, the duct 120 extends from the base of the park and turn lamp 102 substantially vertically toward a section of the rear housing 110 remote from the park and turn lamp 102. In this example, the remote section is in a lower corner of the rear housing 110, below the bezel 118, where the rear housing 110 mates with the front housing 116.

Remote sections of the lamp cavity include those sections of the lamp cavity that are spaced apart from a light source. The air within the remote sections remains cooler than air located in close proximity to one or more light sources, for example, the park and turn lamp 102, based at least partially on the spacing between the remote sections and the light sources. When the headlamp assembly 100 is installed in a vehicle, the outer surface of the front housing 116 is also exposed to environmental elements such as rain, snow, wind, and cold air, affecting the temperature of both the outer surface of the front housing 116 and the inner surface of the front housing 116 adjacent to remote sections of the lamp cavity. Both the remoteness from a light source and the proximity to external weather conditions can cause a rapid cooling of air in one or more remote sections of the lamp cavity, leading to condensation forming in those remote sections of the lamp cavity if moisture is present in the air and the air remains stagnant in the remote sections of the lamp cavity.

The rear duct wall 202 and spaced side duct walls 204, 206 form three sides surrounding a duct cavity. The duct cavity is configured to draw air from the remote section of the lamp cavity toward the light source, e.g. the park and turn lamp 102. The fourth side surrounding the duct cavity is formed by a rear wall of the park and turn reflector 106, thus the duct cavity is an essentially enclosed channel between the remote section and the light source. To either reduce condensation or prevent condensation from occurring in the remote section of the lamp cavity, the park and turn lamp 102 can be operated to heat the air around it, that is, the air at the top of the duct 120. Since heated air expands to a lower air pressure, cooler air having a higher pressure is drawn through the duct cavity from the remote section toward the light source. The draw of air through the duct 120 is one part of the recirculation process that can occur within the lamp cavity to reduce or prevent condensation. The rest of the recirculation process is described in respect to FIG. 3.

Figure 3:
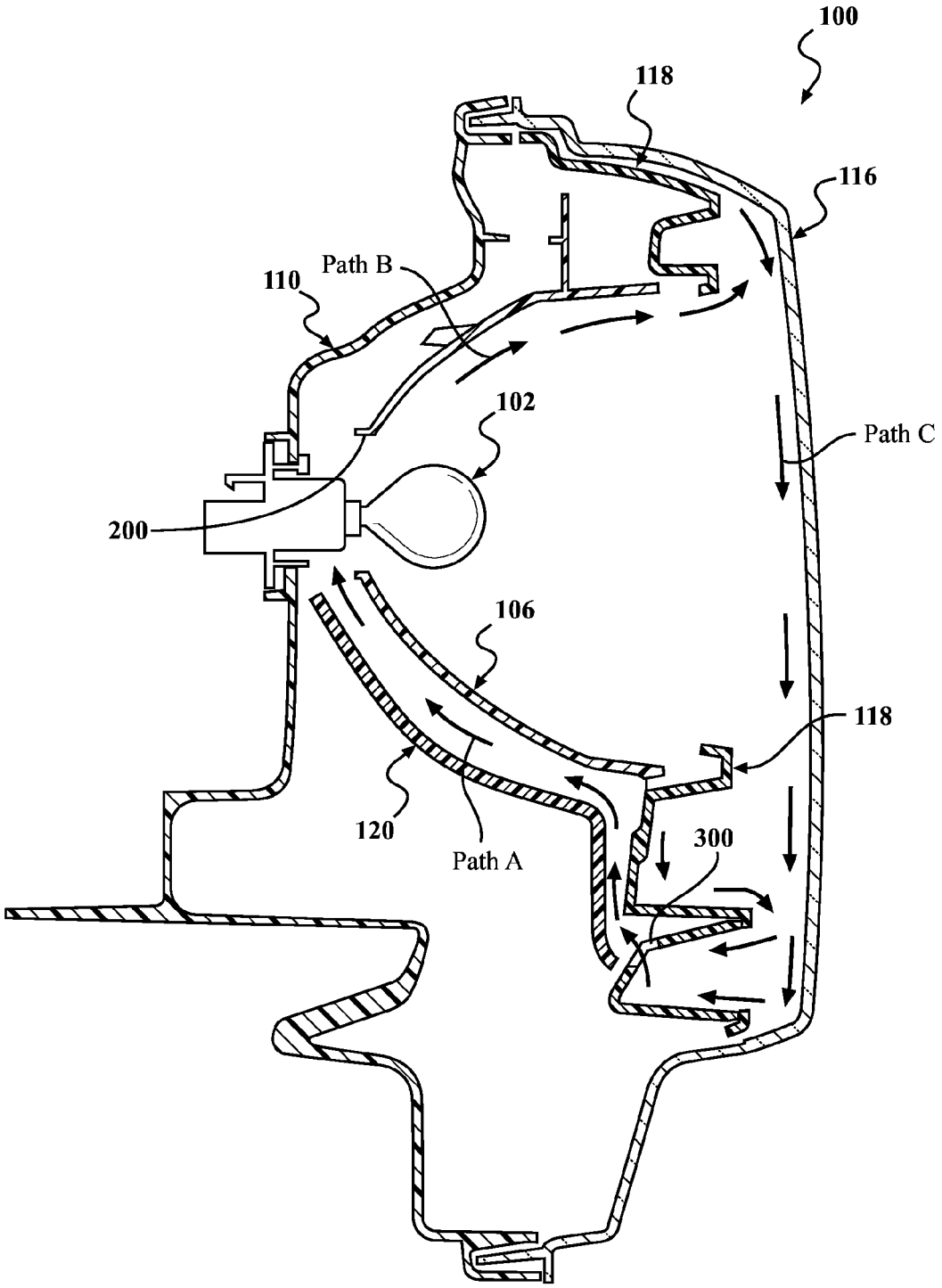
FIG. 3 is a sectional view through a section of the vehicle headlamp assembly designated in FIG. 1.

FIG. 3 is a sectional view through a section of the vehicle headlamp assembly 100 designated in FIG. 1. At both the top and bottom of the sectional view, the rear housing 110 is joined and sealed to the front housing 116 to form the lamp cavity. The park and turn lamp 102 extends from the rear housing 110 into the lamp cavity. The park and turn reflector 106 surrounds the park and turn lamp 102, extending from the rear housing 110 toward the front housing 116. The bezel 118 is shown as extending from the edges of the park and turn reflector 106 to the walls of the front housing 116. Finally, the duct 120 is shown as extending from the park and turn lamp 102, below the park and turn reflector 106, toward a lower portion of the bezel 118 located in a section of the lamp cavity remote from the park and turn lamp 102.

An opening 300 can be formed in a lower portion of the bezel 118 such that air can travel between the portion of the lamp cavity proximate to the front housing and the portion of the lamp cavity proximate to the rear housing 110. The duct 120 and park and turn reflector 106 form a duct cavity that draws air from the opening 300 in the bezel 118 toward the park and turn lamp 102 based on the difference in temperature and pressure at the ends of the duct cavity. Path A is shown in FIG. 3 detailing the travel of air from the opening 300 in the bezel 118 to the portion of the lamp cavity proximate to the park and turn lamp 102. Once the air is heated by the park and turn lamp 102, path B shows the travel of the air away from the park and turn lamp 102 along the wall of the park and turn reflector 106 toward a remote section of the lamp cavity at the top of the headlamp assembly 100 between the bezel 118 and the front housing 116.

One the air reaches the remote section of the lamp cavity at the top of the headlamp assembly 100 between the bezel 118 and the front housing, the air can become cooler based on its remoteness from the park and turn lamp 102 as well as on environmental conditions external to the headlamp assembly 100 that impact the front housing 116. Once it cools, the air starts to sink, flowing along the face of the front housing 116 as shown in path C, down toward the remote section of the lamp cavity between the bezel 118 and front housing 116 at the bottom of the headlamp assembly 100. Before the air can be cooled to a point that condensation would form, it is drawn through the opening 300 in the bezel 118 into the duct 120 and rises toward the park and turn lamp 102 as described above along path A. The air flows from path A to path B to path C as it heats and cools, reducing or eliminating the formation of condensation in remote sections of the lamp cavity.

Figure 4:
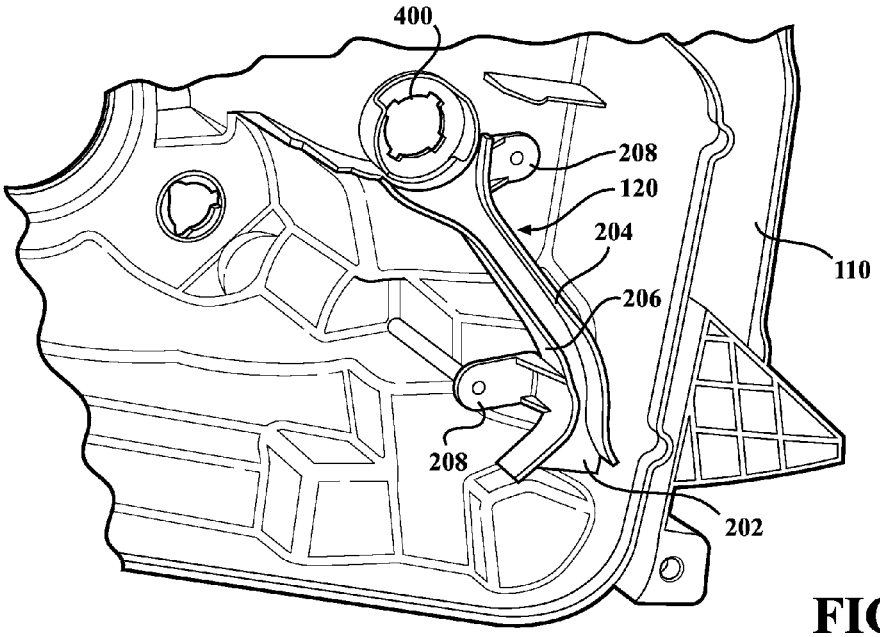
FIG. 4 is a front view of the rear housing and an example duct within the vehicle headlamp assembly of FIG. 1.

FIG. 4 is a front view of the rear housing 110 and an example duct 120 within the vehicle headlamp assembly 100 of FIG. 1. The example duct 120 shown includes a rear duct wall 202, side duct walls 204, 206 and a pair of brackets 208 for mating the duct 120 to the rear housing 110. The duct 120 extends substantially vertically between an opening 400 in the rear housing 110 for receiving a light source and a lower portion of the rear housing 110. The twisting shape of the duct 120 is such that the side duct walls 204, 206 extend to reach a rear wall of the park and turn reflector 106 (not shown here) to form the duct cavity to draw air from the lower portion of the rear housing 110 toward the light source.

Figure 5:
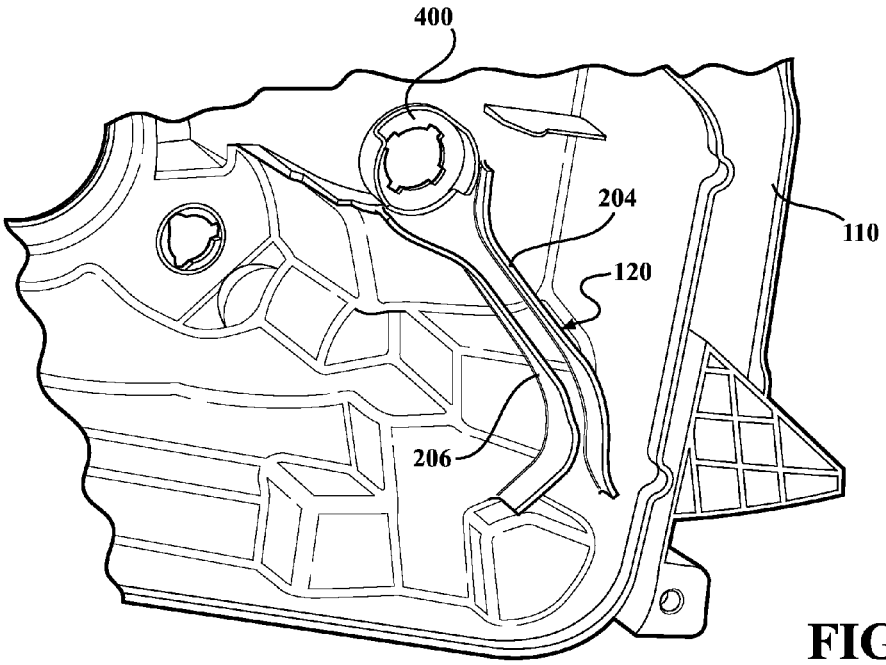
FIG. 5 is a front view of the rear housing of FIG. 1 and an alternative example duct design.

FIG. 5 is a front view of the rear housing 110 of FIG. 1 and an alternative example duct 120 design. In this example, the pair of spaced side duct walls 204, 206 extend substantially perpendicularly from the rear housing 110 to reach a rear wall of the park and turn reflector 106 (not shown here) to form the duct cavity to draw air from the lower portion of the rear housing 110 toward the light source. As shown by the examples in FIGS. 4 & 5, the spaced side duct walls 204, 206 can be formed as part of a separate duct 120 to be mated to the rear housing 110 or can be integrated directly into the rear housing 110, depending on design constraints for the headlamp assembly 100.

The foregoing description relates to what are presently considered to be the most practical embodiments. It is to be understood, however, that the disclosure is not to be limited to these embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A lamp assembly for reducing condensation, comprising:

a rear housing;

a front housing configured to mate to the rear housing to form a lamp cavity;

a light source extending from the rear housing into the lamp cavity;

a reflector extending from the rear housing toward the front housing adjacent to the light source; and a duct including a rear duct wall and spaced side duct walls extending between the rear housing and the reflector from the light source to a remote section of the lamp cavity spaced from the light source wherein the duct and a wall of the reflector form a duct cavity configured to draw air from the remote section of the lamp cavity toward the light source.

2. The lamp assembly of claim 1 wherein the reflector is configured to reflect light from the light source through the front housing.

3. The lamp assembly of claim 1 wherein the remote section of the lamp cavity is below the light source.

4. The lamp assembly of claim 1 wherein the duct extends substantially vertically between the light source and the remote section of the lamp cavity.

5. The lamp assembly of claim 1 wherein the duct includes one or more brackets for mounting the duct to the rear housing.

6. A lamp assembly for reducing condensation, comprising:

a rear housing;

a front housing configured to mate to the rear housing to form a lamp cavity;

a light source extending from the rear housing into the lamp cavity;

a reflector extending from the rear housing toward the front housing adjacent to the light source; and a pair of spaced side duct walls extending substantially perpendicularly from the rear housing toward the reflector and extending from the light source to a remote section of the lamp cavity spaced from the light source wherein a front wall of the rear housing and a rear wall of the reflector and the spaced side duct walls form a duct cavity configured to draw air from the remote section of the lamp cavity toward the light source.

7. The lamp assembly of claim 6 wherein the reflector is configured to reflect light from the light source through the front housing.

8. The lamp assembly of claim 6 wherein the remote section of the lamp cavity is below the light source.

9. The lamp assembly of claim 6 wherein the duct extends substantially vertically between the light source and the remote section of the lamp cavity.

10. A lamp assembly for reducing condensation, comprising:

a lamp housing including a front housing and a rear housing forming a lamp cavity;

a light source extending from the rear housing into the lamp cavity;

a reflector extending around the light source; and a duct including a pair of spaced side duct walls extending between the rear housing and the reflector from the light source to a remote section of the lamp cavity spaced from the light source to define a duct cavity configured to draw air from the remote section of the lamp cavity toward the light source.

11. The lamp assembly of claim 10 wherein the duct includes a rear duct wall and the pair of spaced side duct walls extend substantially perpendicularly from the rear duct wall.

12. The lamp assembly of claim 10 wherein the duct includes one or more brackets for mounting the duct to the rear housing.

13. The lamp assembly of claim 11 wherein the rear duct wall and the pair of spaced side duct walls and a rear wall of the reflector form the duct cavity.

14. The lamp assembly of claim 10 wherein the pair of spaced side duct walls extend substantially perpendicularly from the rear housing.

15. The lamp assembly of claim 14 wherein a front wall of the rear housing and a rear wall of the reflector and the pair of spaced side duct walls form the duct cavity.

16. The lamp assembly of claim 10 wherein the reflector is configured to reflect light from the light source through the front housing.

17. The lamp assembly of claim 10 wherein the remote section of the lamp cavity is below the light source.

18. The lamp assembly of claim 10 wherein the duct extends substantially vertically between the light source and the remote section of the lamp cavity.

* * * * *